US007506399B2

(12) United States Patent
Fortune

(10) Patent No.: US 7,506,399 B2
(45) Date of Patent: Mar. 24, 2009

(54) SPREADER FOR FLOOR DRESSING MATERIAL

(75) Inventor: Ryan Fortune, Thornton, CO (US)

(73) Assignee: Ardex, L.P., Aliquippa, PA (US)

( * ) Notice: Subject to any disclaimer, the term of this patent is extended or adjusted under 35 U.S.C. 154(b) by 694 days.

(21) Appl. No.: 10/846,303

(22) Filed: May 14, 2004

(65) Prior Publication Data

US 2005/0251945 A1 Nov. 17, 2005

(51) Int. Cl.
*B05C 17/10* (2006.01)

(52) U.S. Cl. ..... 15/245.1; 15/245

(58) Field of Classification Search ..... 15/245.1, 15/245, 236.01; D32/41
See application file for complete search history.

(56) References Cited

U.S. PATENT DOCUMENTS

| | | | | |
|---|---|---|---|---|
| 1,684,625 | A * | 9/1928 | Hillyard | 15/245 |
| 2,043,775 | A * | 6/1936 | Rosen | 15/245 |
| 3,803,662 | A | 4/1974 | Glejf | |
| 4,094,037 | A * | 6/1978 | Karpp | 15/245 |
| 4,467,490 | A * | 8/1984 | Adams | 15/105 |
| 4,982,470 | A | 1/1991 | Szabo | |
| 5,379,479 | A | 1/1995 | Nelson | |
| 5,460,461 | A | 10/1995 | McGrath | |
| 5,778,482 | A * | 7/1998 | Sbrigato | 15/245.1 |
| 6,202,249 | B1 | 3/2001 | Jenkins et al. | |
| 6,308,370 | B1 | 10/2001 | Southby | |
| 2006/0137125 | A1 | 6/2006 | Goller | |

* cited by examiner

*Primary Examiner*—Laura C Guidotti
(74) *Attorney, Agent, or Firm*—Eckert Seamans Cherin & Mellott, LLC; Daniel C. Abeles, Esq.

(57) ABSTRACT

A floor dressing spreader includes an elongated handle and an elongated back-up plate. The elongated handle is secured to the back-up plate and extends generally upwardly therefrom. Front and rear attachment plates are disposed adjacent lower portions of the back-up plate and a resilient flexible spreader element is clamped between an attachment plate and the back-up plate. The spreader extends downwardly beyond the lower edge of the back-up plate for spreading the concrete dressing material. The resilient spreader is preferably composed of a material which is flexible and resiliently deformable such as a rubber material.

15 Claims, 4 Drawing Sheets

SPREADER FOR FLOOR DRESSING MATERIAL

BACKGROUND OF THE INVENTION

1. Field of the Invention

The present invention relates to a spreader for a floor dressing material and more specifically, it relates to such a spreader which has an elongated handle and a downwardly projecting resilient spreader element for applying dressing material over concrete, asphalt and similar surfaces.

2. Description of the Prior Art

U.S. Pat. No. 5,460,461 discloses a manual concrete screed handle wherein the elongated handle is secured to a clamping plier that receives and clamps a screed member.

U.S. Pat. No. 3,803,662 is directed toward a carpet adhesive spreader and has a serrated blade and mounting member hinged to a frame member between push and pull stops. The frame member is pivotally connected to a long handle and pivots about an axis perpendicular to the handle to control the flow of excess adhesive.

U.S. Pat. No. 4,982,470 discloses a manually operable device for applying adhesive to floor coverings which permits the user to remain in standing position. The device has an elongated handle and an operating rod which is separately gripped and is connected to a serrated spatula which has an irregular lower surface.

U.S. Pat. No. 6,308,370 discloses an adhesive spreader which has blade having a rectangular planar portion with a plurality of indentations and a pair of generally perpendicular flange portions. Gripping is effected directly over the rectangular planar portion.

U.S. Pat. No. 5,379,479 discloses a long handle adhesive spreader having a housing which receives an upper end of a blade and overlying upwardly projecting pins which receive weights thereon for providing a downward force on the blade.

U.S. Provisional Patent Application Ser. No. 60/545,761, which is owned by the assignee of the present invention, discloses a trowel having an elongated handle with a pair of first and second blades of different height and a pair of weights secured to a blade and handle connector portion.

U.S. Pat. No. 6,202,249 discloses a long-handled floor-coating applicator device having a removable weight system and a removable applicator. The applicator is said to resist wicking of the coating material into the applicator.

There remains, therefore, a very real and substantial need for an improved long handle spreader which will in a controlled and efficient manner permit spreading of concrete dressing material and the like.

SUMMARY OF THE INVENTION

The present invention has a floor dressing spreader with an elongated handle secured to an elongated back-up plate with the elongated handle extending generally upwardly from the back-up plate. A front attachment plate is disposed adjacent a lower portion of the back-up plate and a rear attachment plate is disposed adjacent a rear portion of the back-up plate. A resilient spreader element is clamped between one of the attachment plates and the back-up plate and extends downwardly from the back-up plate for spreading the floor dressing material.

Mechanical fasteners may secure the assembly of the front and back attachment plates and resilient spreader.

The resilient spreader preferably is of solid rubber material which is flexible to facilitate spreading the concrete or asphalt dressing material.

The handle preferably extends along at least a major portion of the vertical extent of the back-up plate and most preferably, extends toward the lower end thereof. Suitable brackets for surrounding engagement and securement of the lower handle portion to the back-up plate are provided on one side of the back-up plate with an attachment plate to which the bracket elements are secured disposed on the other side of the back-up plate.

It is an object of the present invention to provide a floor dressing spreader which is structured to enable the user to remain standing while spreading the material.

It is a further object of the present invention to provide such a long-handled floor dressing spreader which will facilitate efficient uniform distribution of the dressing material over an underlying surface regardless of whether the surface is smooth or irregular.

It is yet another object of the present invention to provide such a spreader which employs a downwardly projecting spreader element which is resilient and facilitates spreading of the dressing material.

These and other objects of the invention will be more fully understood from the following detailed description of the invention on reference to the illustrations appended hereto.

DESCRIPTION OF THE PREFERRED EMBODIMENTS

Figure 1:
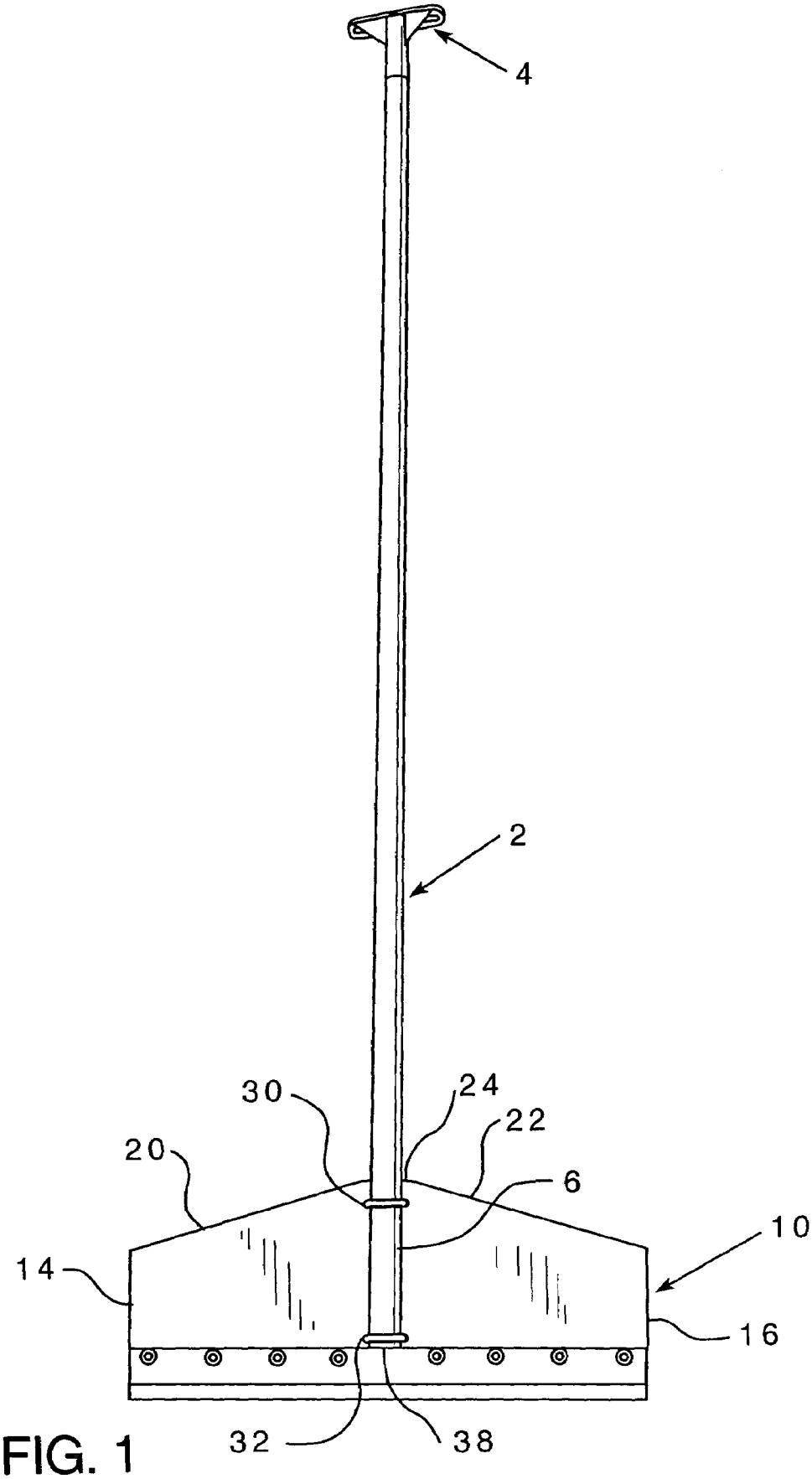
FIG. 1 shows a front elevational view of a form of spreader of the present invention.
Figure 2:
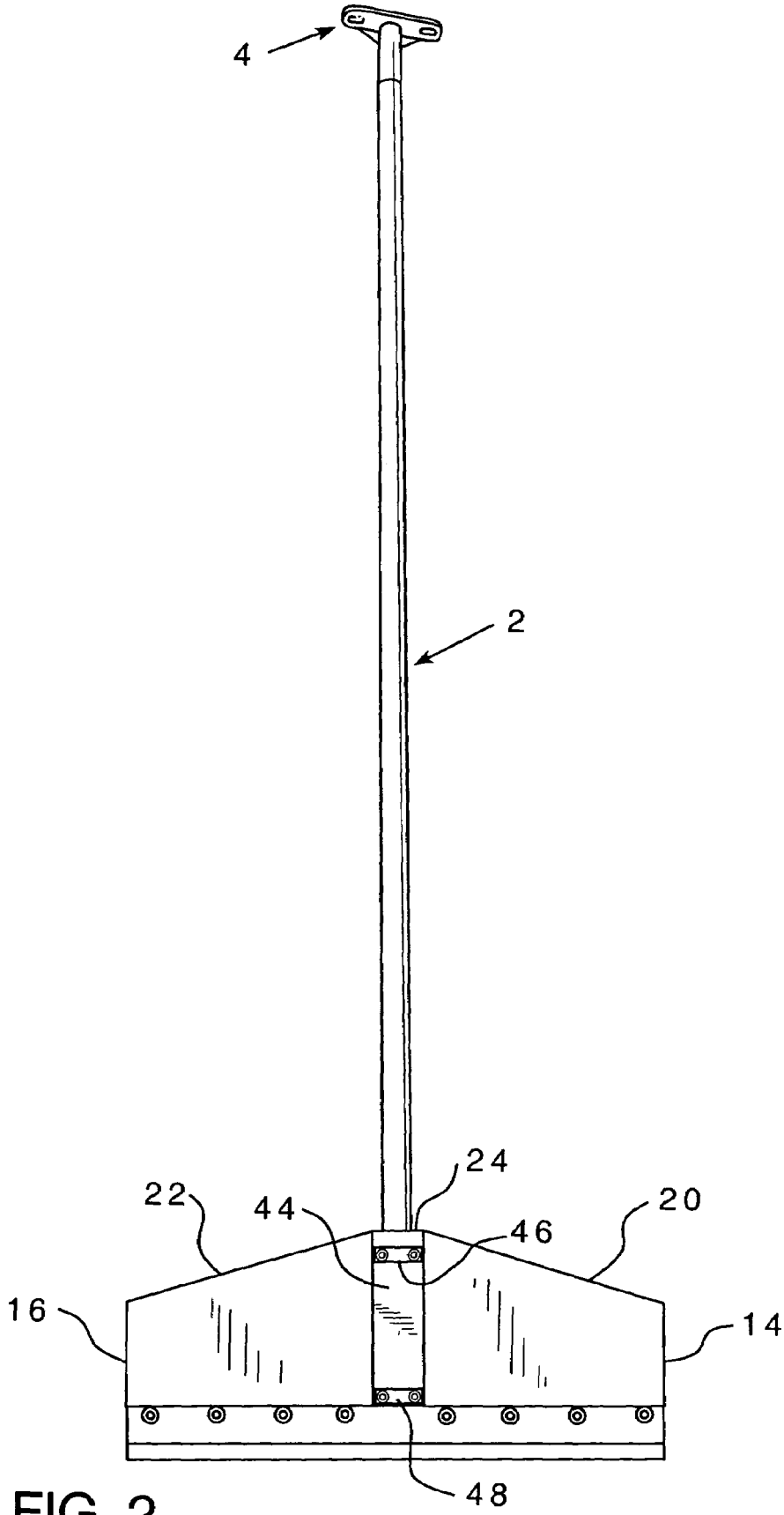
FIG. 2 shows a rear elevational view of the spreader of FIG. 1.

As employed herein, the expression "floor dressing" will be employed to refer to chemical substances applied in flowable form to interior or exterior generally horizontal surfaces including floor surfaces in order to fill cracks, voids and otherwise provide a protective surface layer thereon once the material has set. The floor may be composed of concrete, asphalt or similar materials. The term will expressly include but not be limited to materials of the type sold under the trademark "ARDEX CD" by Ardex Engineered Cements of Aliquippa, Pa.

Referring to FIGS. 1 through 4, there is shown a floor dressing spreader of the captioned invention which has an elongated handle 2 terminating at its free end with a transversely enlarged end of portion 4. Adjacent the lower portion 6 of the handle is a back-up plate 10 which has a pair of generally parallel end edges 14, 16 terminating in generally upwardly sloping edges 20, 22 which meet upper surface 24 adjacent to a lower handle portion 6. In the form shown, the handle 2 is secured to the back-up plate 10 by means of a plurality of brackets 30, 32 which in the form illustrated are two in number, but could involve more than that number if desired. It will be appreciated that the lower end of the handle 38 terminates adjacent a lower portion of the back-up plate 10. As shown, plate 44 with two apertured, elongated washer plates 46, 48 through which the free ends 50, 52, 64, 66 of brackets 30, 32 pass. Free ends 50, 52 are secured respectively by nuts 54, 56. The free ends 60, 62 of bracket 32 are secured by nuts 64, 66. This places the lower handle 6 in intimate contact with the back-up plate 10 with the longitudinal axis of the handle 2 being generally parallel to the adjacent surface of the back-up plate 10.

Figure 4:
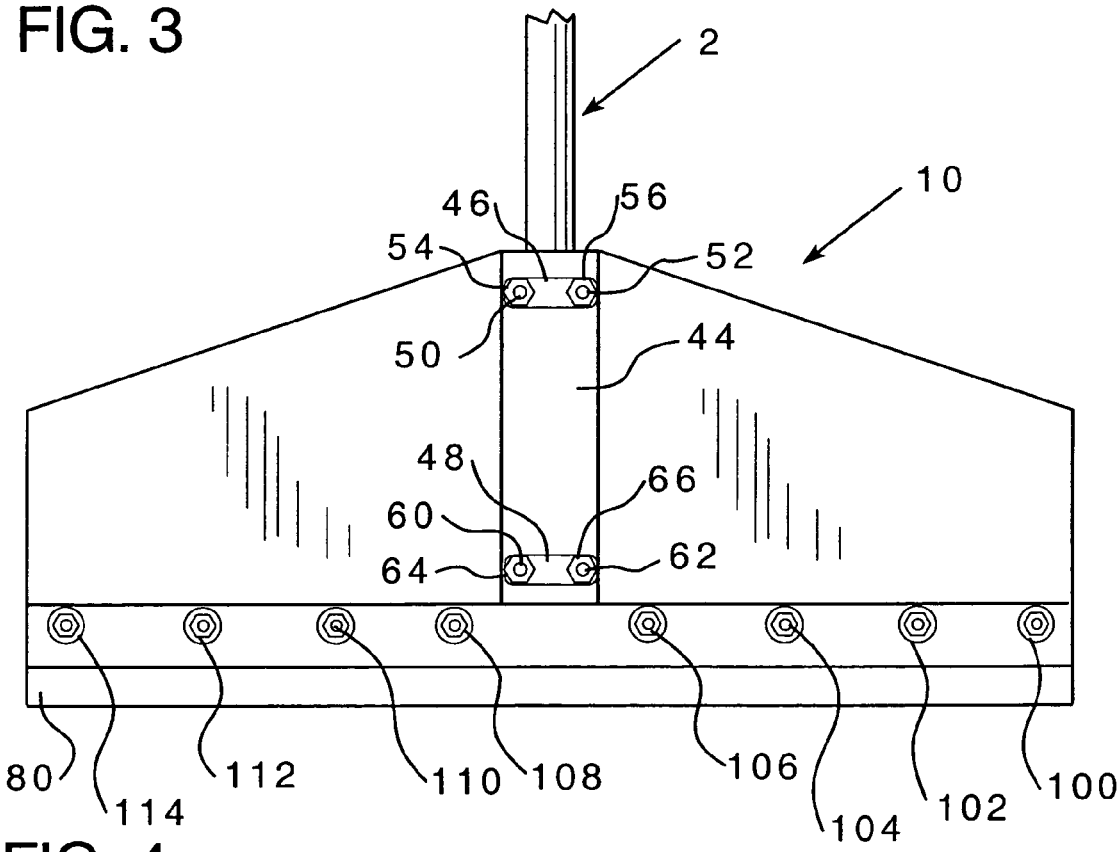
FIG. 4 is a rear elevational view of the portion of the spreader shown in FIG. 1.
Figure 5:
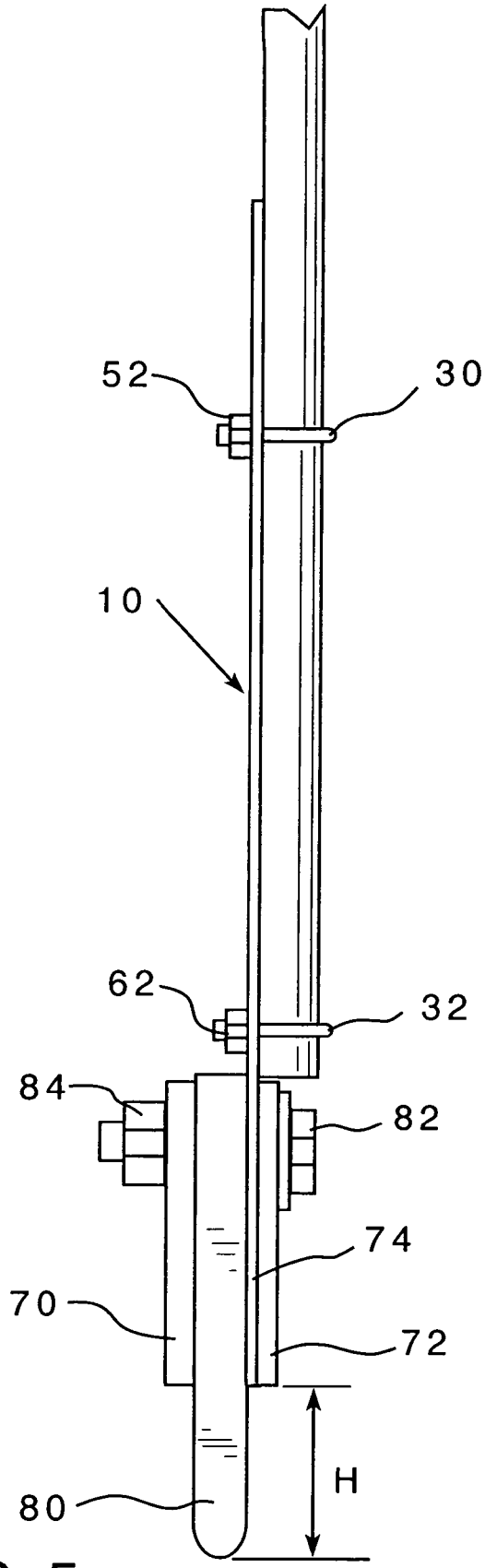
FIG. 5 is a right-side elevational view of the spreader portion shown in FIG. 4.

Referring to FIGS. 4 and 5 with the latter showing a front attachment plate 70, a back attachment plate 72 and spreader element 80. It will be appreciated that the spreader element 80 in the form shown is clamped between the lower portion 74 of back-up plate 10 and the front attachment plate 70 by means of bolt 82 which is operatively associated with nut 84. The resilient spreader element 80 projects downwardly beyond the lowermost portions of front attachment plate 70 and rear attachment plate 72 by a distance H which preferably is about 0.5 to 1 inch. If desired, while not preferred, the rear attachment plate 72 could be eliminated.

Figure 3:
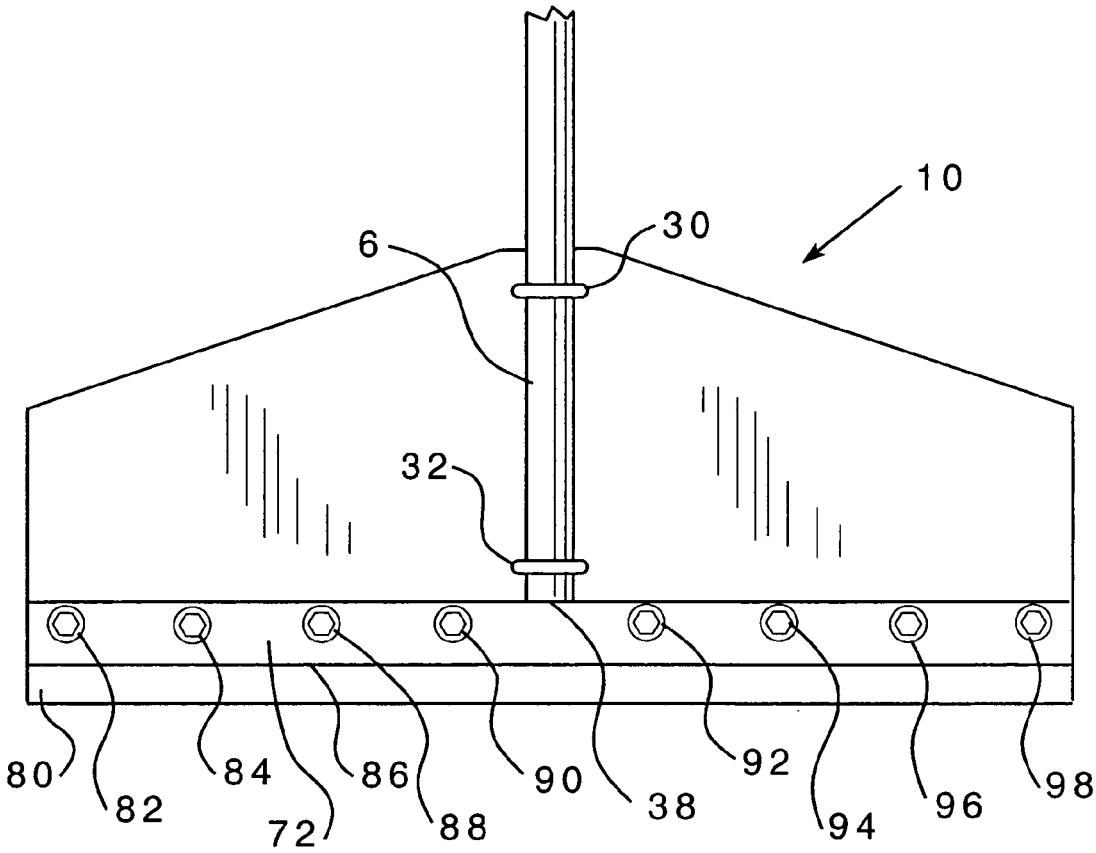
FIG. 3 is an elevational view of a portion of the spreader shown in FIG. 1.

Referring to the FIG. 3, it will be appreciated that a plurality of bolts 82, 84, 88, 90, 92, 94, 96, 98 cooperate with corresponding nuts (FIG. 4) 100, 102, 104, 106, 108, 110, 112, 114 respectively to establish the clamped relationship shown in FIG. 5. It will be appreciated that the front attachment plate 70 and rear attachment plate 72 as well as the resilient projecting spreader element 80 will be generally co-extensive in length with the back-up plate 10.

It is preferred that the resilient spreader element 80 be flexible in order to spread the floor dressing onto the surface being treated. A suitable material for use in this resilient spreader element 80 is a rubber material such as a squeegee-type material. It may have a solid cross-section. The elongated spreader element 80 preferably has a height of about 2 to 3 inches and a thickness of about 0.2 to 0.3 inch. It preferably has a substantially uniform thickness and generally rectangular cross-section.

It will be appreciated that in this manner the user may deposit flowable material on the concrete or asphalt surface to be treated and while remaining standing through moving of the spreader such that the resilient spreader element 80 contacts the material to be spread through reciprocating and other appropriate movements cause the material to be spread in the desired regions with uniformity of surface coverage. The back-up plate 10 as well as the attachment plates 70, 72 may be made of steel. The back-up plate 10 preferably will have a thickness of about 0.05 to 0.07 inch in order to provide the desired rigidity of support and unitary action with the handle 2.

Whereas particular embodiments of the invention have been described herein for purposes of illustration, it will be evident to those skilled in the art that numerous variations of the details may be made without departing from the invention as set forth in the appended claims.

The invention claimed is:

1. A floor dressing spreader structured to distribute a floor dressing comprising:

an elongated handle;

a back-up plate having an elongated dimension;

said elongated handle secured to and in intimate direct contact with said back-up plate and extending generally upwardly from said back-up plate;

a first attachment plate disposed adjacent a lower portion of said back-up plate;

a second attachment plate secured on the opposite side of said back-up plate from said first attachment plate having a dimension which corresponds to and is substantially coextensive with the elongated dimension of said back-up plate;

a resilient spreader for distributing said floor dressing secured between said first attachment plate and said back-up plate along the elongated dimension, said resilient spreader projecting downwardly from said back-up plate for spreading said floor dressing; and mechanical fasteners securing said first attachment plate and said second attachment plate to said back-up plate with said spreader secured between said first attachment plate and said back-up plate.

2. The spreader of claim 1, including said resilient spreader being composed of rubber.

3. The spreader of claim 2, including said rubber spreader being substantially solid.

4. The spreader of claim 2, including said rubber spreader having a generally rectangular cross-section.

5. The spreader of claim 1, including said resilient spreader projecting about 0.5 to 1 inch below the lower edge of said first attachment plate.

6. The spreader of claim 5, including said resilient spreader having an average thickness of about 0.05 to 0.07 inch.

7. A floor dressing spreader structured to distribute a floor dressing comprising:

an elongated handle;

an elongated back-up plate;

said elongated handle secured to said back-up plate and extending generally upwardly from said back-up plate;

a first attachment plate disposed adjacent a lower portion of said back-up plate;

a second attachment plate secured on the opposite side of said back-up plate from said first attachment plate;

a resilient spreader for distributing said floor dressing secured between said first attachment plate and said back-up plate, said resilient spreader projecting downwardly from said back-up plate about 0.5 to 1 inch below the lower edge of said front attachment plate for spreading said floor dressing;

mechanical fasteners securing said first attachment plate and said second attachment plate to said back-up plate with said spreader secured between said attachment plate and said back-up plate;

a plurality of attachment brackets secured to said back-up plate; and said handle passing through said attachment brackets.

8. The spreader of claim 7, including a handle attachment plate secured adjacent a first side of said back-up plate generally opposite to the side of said back-up plate to which said handle is secured.

9. A floor dressing spreader comprising an elongated handle, an elongated back-up plate, said elongated handle secured to said back-up plate and extending generally upwardly from said back-up plate, a first attachment plate disposed adjacent a lower portion of said back-up plate, a resilient spreader secured between said first attachment plate and said back-up plate, said resilient spreader projecting downwardly from said back-up plate for spreading said floor dressing, said resilient spreader projecting about 0.5 to 1 inch below the lower edge of said front attachment plate, a plurality of attachment brackets secured to said back-up plate, said handle passing through said attachment brackets, a handle attachment plate secured adjacent a first side of said back-up plate generally opposite to the side of said back-up plate to which said handle is secured, said attachment brackets passing through said back-up plate, and being secured to said handle attachment plate.

10. The spreader of claim 9, including said handle extending downwardly to adjacent the lower edge of said back-up plate.

11. The spreader of claim 9, including said back-up plate being substantially rigid.

12. The spreader of claim 11, including said back-up plate being composed of steel.

13. The spreader of claim 11, including said handle having a longitudinal axis which is generally parallel to said back-up plate.

14. The spreader of claim 9, including said first and second attachment plates being longitudinally substantially co-extensive with the back-up plate.

15. The spreader of claim 13, including said resilient spreader being substantially longitudinally co-extensive with the attachment plates.

* * * * *